US006969075B2

(12) United States Patent
Dean et al.

(10) Patent No.: US 6,969,075 B2
(45) Date of Patent: Nov. 29, 2005

(54) SNOWBOARD BINDING WITH REDUCED VERTICAL PROFILE

(75) Inventors: Gregory Aaron Dean, Shelburne, VT (US); Douglas V. Poscich, Hinesburg, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 10/690,491

(22) Filed: Oct. 21, 2003

(65) Prior Publication Data

US 2005/0082790 A1 Apr. 21, 2005

(51) Int. Cl.[7] ..... A63C 9/04
(52) U.S. Cl. ..... 280/14.22; 280/607
(58) Field of Search ..... 280/623, 624, 280/14.21, 600, 601, 607, 613, 617, 619, 280/620, 633, 634, 635, 14.22

(56) References Cited

U.S. PATENT DOCUMENTS

| | | | | | |
|---|---|---|---|---|---|
| 5,261,689 | A | * | 11/1993 | Carpenter et al. | 280/618 |
| 5,277,635 | A | | 1/1994 | Gillis | |
| D346,419 | S | * | 4/1994 | Carpenter | D21/773 |
| 5,356,170 | A | * | 10/1994 | Carpenter et al. | 280/618 |
| 5,556,123 | A | | 9/1996 | Fournier | |
| 5,660,410 | A | * | 8/1997 | Alden | 280/627 |
| 5,713,587 | A | | 2/1998 | Morrow et al. | |
| 5,727,797 | A | | 3/1998 | Bowles | |
| 5,918,897 | A | | 7/1999 | Hansen et al. | |
| 6,231,057 | B1 | * | 5/2001 | Reuss et al. | 280/14.21 |
| 6,270,110 | B1 | * | 8/2001 | Laughlin et al. | 280/617 |
| 6,283,482 | B1 | * | 9/2001 | Coulter | 280/14.22 |
| 6,283,495 | B1 | * | 9/2001 | Phillips | 280/618 |
| 6,394,484 | B1 | * | 5/2002 | Maravetz et al. | 280/624 |
| 6,554,295 | B2 | * | 4/2003 | Rittmeyer | 280/11.3 |
| 6,557,865 | B1 | * | 5/2003 | Reuss et al. | 280/14.21 |
| 6,581,944 | B1 | | 6/2003 | Marmonier et al. | |
| 6,709,003 | B2 | * | 3/2004 | Laughlin et al. | 280/623 |
| 6,729,642 | B2 | * | 5/2004 | Gouzes et al. | 280/623 |
| 2002/0163161 | A1 | | 11/2002 | Mandon | |

FOREIGN PATENT DOCUMENTS

| | | | |
|---|---|---|---|
| EP | 0838248 | A1 | 4/1998 |
| FR | 2720655 | A1 | 8/1995 |
| JP | 9-678 | | 1/1997 |
| JP | 11-342236 | | 12/1999 |
| JP | 3069806 | | 7/2000 |
| JP | 2000-237369 | | 9/2000 |
| JP | 2002-065930 | | 3/2002 |
| WO | WO 98/47398 | A1 | 10/1998 |

* cited by examiner

*Primary Examiner*—Christopher P. Ellis
*Assistant Examiner*—J. Allen Shriver
(74) *Attorney, Agent, or Firm*—Wolf, Greenfield & Sacks, P.C.

(57) ABSTRACT

A snowboard binding includes a highback that is pivotally mounted relative to a base and movable between a riding position and a folded position. In the folded position, the highback may be positioned lower than an uppermost portion of a heel hoop. In one embodiment, all portions of the binding when the highback is in a folded position may lie within a maximum distance of 3 inches or less.

46 Claims, 7 Drawing Sheets

SNOWBOARD BINDING WITH REDUCED VERTICAL PROFILE

BACKGROUND OF INVENTION

1. Field of Invention

This invention relates to a snowboard binding having a reduced vertical profile.

2. Description of Related Art

Snowboard bindings, virtually all strap models and certain step-in versions, include a highback that supports the rear portion of a rider's boot and/or leg. As is well understood by those of skill in the art, a highback can allow a rider to more quickly and effectively tilt a snowboard onto a heel-side edge. Such highbacks are often pivotally mounted to the binding so that the highback can be rotated or folded forward. Folding the highback forward can reduce the overall height of the binding, such as when storing a snowboard and attached binding and when carrying a snowboard and binding on a vehicle roof rack. Snowboard rental shops typically fold the highback down on bindings when storing snowboards between uses. Snowboards having step-in bindings with no highback are usually stored in racks separately from snowboards having strap bindings with a highback. The reason these boards are stored separately is that boards with step-in bindings usually have an overall height (the distance from the bottom of the board to the highest point on the binding above the board top surface) of about 3 inches, whereas boards with strap bindings have an overall height of about 4 inches or more. As a result, racks for boards with step-in bindings having no heel hoop or highback are made to accommodate about a 3 inch overall height for each board, and racks for boards with strap bindings and highbacks are made to accommodate about a 4 inch overall height for each board. The decline in popularity of step-in bindings has meant that fewer boards with step-in bindings are rented by riders, and thus rental shops have large numbers of unused racks for boards with step-in bindings.

FIG. 15 shows a prior art strap binding 1 mounted to the top surface 101 of a snowboard 100 (straps are not shown on the binding for clarity). The binding 1 has a base 2 with sidewalls 3 and a highback 5 mounted at a pivot point 6 near the mid-point of the base 2. The pivot point 6 is located about 0.75 inches above the top surface 101 of the snowboard 100 and about 4 inches forward of a rearwardmost portion of the heel hoop 7. (As used herein, the rear or heel end of the binding 1 is toward the right in FIG. 15, the front or toe end of the binding 1 is toward the left in FIG. 15, a bottom of the binding 1 is toward an interface of the binding 1 with the snowboard 100, and an upper portion of the binding 1 is opposite the bottom and away from the snowboard 100.) Relatively long arms 5*a* of the highback 5 extend from the pivot point 6 toward the heel hoop 7. A lean adjuster 10 is carried on a rear portion of the highback 5 to adjust the rotational position of the highback about the pivot point 6.

FIG. 16 shows another prior art strap binding 1 mounted to the top surface 101 of a snowboard 100. Similar to the FIG. 15 binding, the binding 1 includes a base 2, sidewalls 3, and a highback 5 mounted at a pivot point 6. However, the FIG. 16 binding has the pivot point 6 located relatively high on the heel hoop 7 at a point about 2.75 inches above the top surface 101 and about 2 inches forward of the rearwardmost portion of the heel hoop 7. It can also be seen that the pivot point 6, like that in the FIG. 15 binding, is located forward of the rearwardmost portion of the floor 22 of the base 2. A lean adjuster 10 is carried by the highback 5 and is used to adjust the rotational position of the highback 5 about the pivot point 6.

FIGS. 17 and 18 show the FIGS. 15 and 16 bindings, respectively, with the highback in a folded position. In both bindings, the highback is positioned above the heel hoop and other portions of the binding. Specifically, the bindings have a height h, a perpendicular distance measured from the bottom surface 21 of the bindings 1 that interfaces with the top surface 101 of the snowboard 100 to the uppermost portion of the binding 1, in this case the highback 5 and/or the lean adjuster 10 carried by the highback 5. This height h varies with different binding types, but generally is about 3.5 inches or more for strap bindings. Since it can be generally assumed that snowboards have a thickness of about 0.5 inches where the bindings are mounted, the overall height oh measured from the bottom surface 102 of the snowboard 100 to the uppermost portion of the binding for strap bindings generally is about 4 inches or more.

SUMMARY OF INVENTION

The inventors have appreciated that the stack height of prior art strap bindings is usually limited by the dimensions and mounting location of the highback. The inventors have developed highback construction and mounting arrangements to lower the height of the highback when folded while still maintaining desirable performance characteristics of the highback during riding. In addition, the inventors have developed a construction and arrangement for a heel hoop on the binding that enables a lower highback position when folded, as well as an overall smaller height for the binding.

In one aspect of the invention, a snowboard binding includes a base constructed and arranged to be mounted to a snowboard and to support at least a portion of a rider's foot. The base has a bottom surface that is adjacent a snowboard top surface when the base is mounted to a snowboard. At least one engagement member is constructed and arranged to extend across and secure the rider's foot to the base, and a heel hoop extending from the base is constructed and arranged to extend around a rider's heel when the rider's foot is positioned in the binding. The heel hoop has an uppermost portion and a rearwardmost portion. A rear support member, including a highback, is constructed and arranged to support a rear portion of the rider's leg. The rear support member is movable between a riding position in which the rear support member is arranged to support the rear portion of the rider's leg and a folded position in which all portions of the rear support member are positioned at a height from the bottom surface of the base that is less than a height of an uppermost portion of the heel hoop from the bottom surface of the base.

In one aspect of the invention, a snowboard binding includes a base constructed and arranged to be mounted to a snowboard and to support at least a portion of a rider's foot. The base has a bottom surface that is adjacent a snowboard top surface when the base is mounted to a snowboard. A pair of sidewalls extend in a heel-to-toe direction on opposite sides of the base, and at least one engagement member is constructed and arranged to extend across and secure the rider's foot to the base. A heel hoop extends from the base and is constructed and arranged to extend around a rider's boot heel when the boot is positioned in the binding. The heel hoop has a rearwardmost portion. A highback is constructed and arranged to support a rear portion of the rider' leg and is pivotally connected relative to the base. The highback is movable between a riding position in which the rear support member is arranged to support the rear portion of the rider's leg and a folded position in which the highback is folded toward a toe side of the base. All portions of the highback and heel hoop are positioned within a distance of at most 3 inches from the bottom surface of the base when the highback is in the folded position. In one embodiment, all portions of the highback and heel hoop are positioned within a distance of at most 2.75 inches from the bottom surface of the base when the highback is in the folded position, or more preferably a distance of at most 2.5 inches from the bottom surface of the base.

In one aspect of the invention, a snowboard binding includes a base constructed and arranged to be mounted to a snowboard and to support at least a portion of a rider's foot. The base has a bottom surface that is adjacent a snowboard top surface when the base is mounted to a snowboard. At least one engagement member is constructed and arranged to secure the rider's foot to the base, and a heel hoop is attached to the base and constructed and arranged to extend around a rider's boot heel when the boot is positioned in the binding. The heel hoop has a rearwardmost portion, and a highback is constructed and arranged to support a rear portion of the rider' leg. The highback is pivotally connected relative to the base at a pivot position having a height of no more than 0.75 inches above the bottom surface of the base and no more than 2.25 inches forward of the rearwardmost portion of the heel hoop.

In one aspect of the invention, a snowboard binding includes a base constructed and arranged to be mounted to a snowboard and to support at least a portion of a rider's foot. The base has a bottom surface that is adjacent a snowboard top surface when the base is mounted to a snowboard. At least one engagement member is constructed and arranged to extend across and secure the rider's foot to the base. A rear support member, including a highback, is constructed and arranged to support a rear portion of the rider's leg. The rear support member is movable between a riding position in which the rear support member is arranged to support the rear portion of the rider's leg and a folded position. The highback is pivotally mounted relative to the base at a position no more than 0.75 inches from the bottom surface of the base and rearward of a rearwardmost portion of a floor of the base.

These and other aspects of the invention will be apparent and/or obvious from the following detailed description and appended claims.

BRIEF DESCRIPTION OF DRAWINGS

Aspects of the invention are described in connection with the following illustrative drawings in which like numerals reference like elements, and wherein.

DETAILED DESCRIPTION

Figure 1:
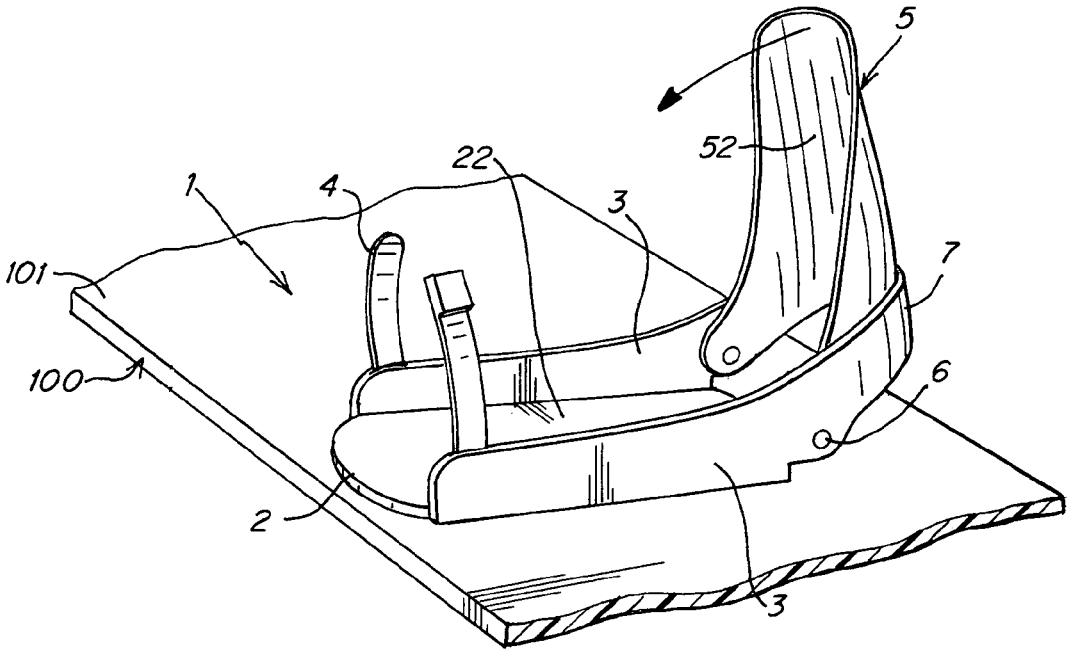
FIG. 1 shows a perspective view of a snowboard binding having a highback pivotally mounted to the heel hoop in one aspect of the invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," "involving" and variations thereof herein, is meant to encompass the items listed thereafter and equivalents thereof as well as additional items.

Figure 2:
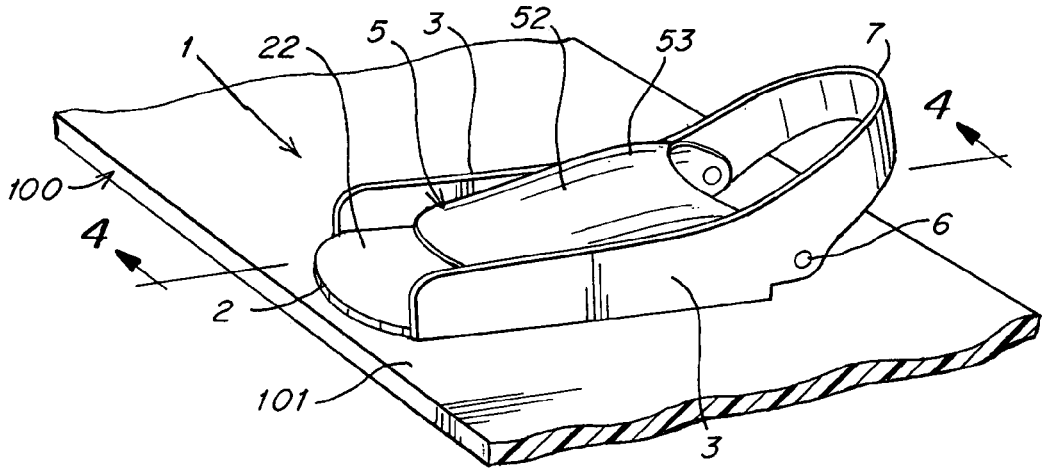
FIG. 2 shows a perspective view of the FIG. 1 embodiment with the highback in a folded position.

FIGS. 1 and 2 show an illustrative embodiment of a snowboard binding 1 incorporating aspects of the invention. The binding includes a base 2 having a floor 22 that supports at least a portion of a rider's foot that is placed in the binding 1 between sidewalls 3 extending in a heel-to-toe direction on opposite lateral sides of the base 2. A heel hoop 7 extends around the rear portion of the rider's foot and a highback 7 is pivotally mounted relative to the base at a pivot point 6. One or more straps or strap assemblies 4 extend over the rider's foot and secure the foot to the binding 1. Although only one strap 4 is shown (i.e., a toe strap), two or more straps (toe, ankle and/or shin straps) may be provided. These straps may have a variable length to extend across the opening in the base 2 where the rider places a foot and secure the foot to the binding 1. As will be understood by those of skill in the art, the various portions of the binding may be made in a unitary form, e.g., molded as a single piece, or made separately and assembled to form the binding 1. For example, the heel hoop 7 may be made separate from the base 2 and later attached to the base at the sidewalls 3, the heel hoop 7 may be molded as one piece with the base 2 and sidewalls 3, or the heel hoop 7 may be omitted entirely or incorporated into the highback 5. Any suitable materials, such as plastic, composites, metal or any combination of such materials may be used to form one or more portions of the binding 1. Moreover, the binding 1 may be mounted to a snowboard 100 using any suitable arrangement, such as a hold down disk that receives fasteners that engage with holes or inserts in the snowboard 100 or other mounting arrangements, as the specific mounting arrangement is not important to various aspects of the invention. Other features found in snowboard bindings may also be provided as desired, including rotational adjustment of the highback 5 (i.e., rotation about an axis perpendicular to the snowboard top surface 101), straps being adjustable in position on the base, an adjustable toe ramp, etc.

Figure 3:
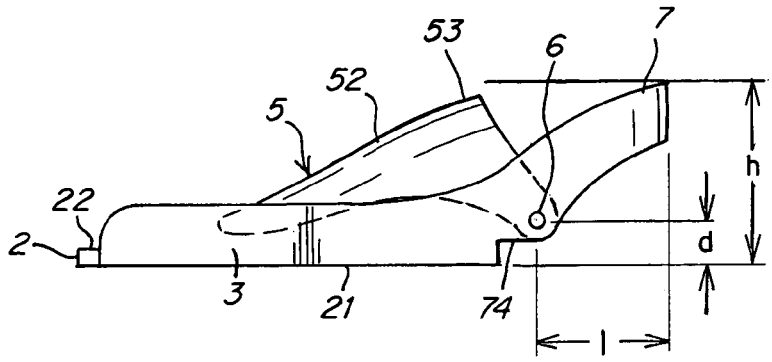
FIG. 3 shows a side view of the FIG. 1 embodiment.
Figure 15:
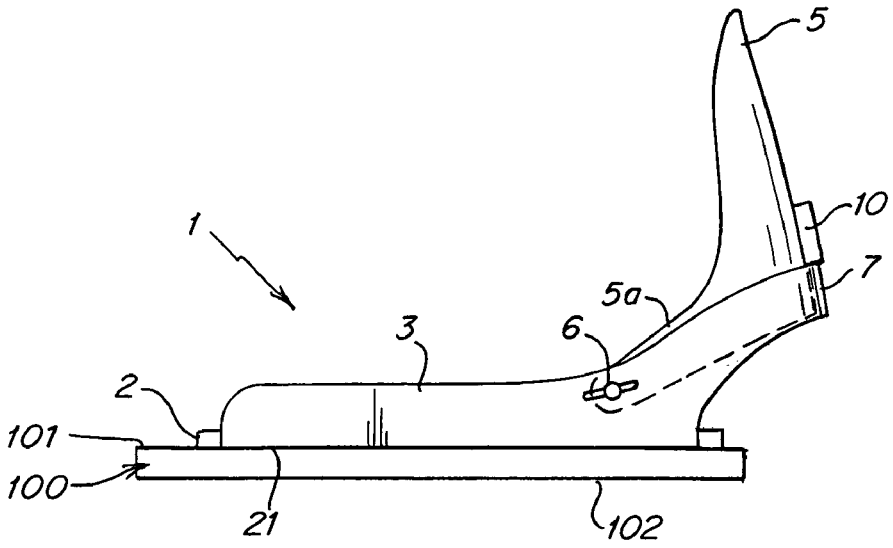
Fig. 15 PRIOR ART
FIG. 15 shows a first embodiment of a prior art strap binding.
Figure 16:
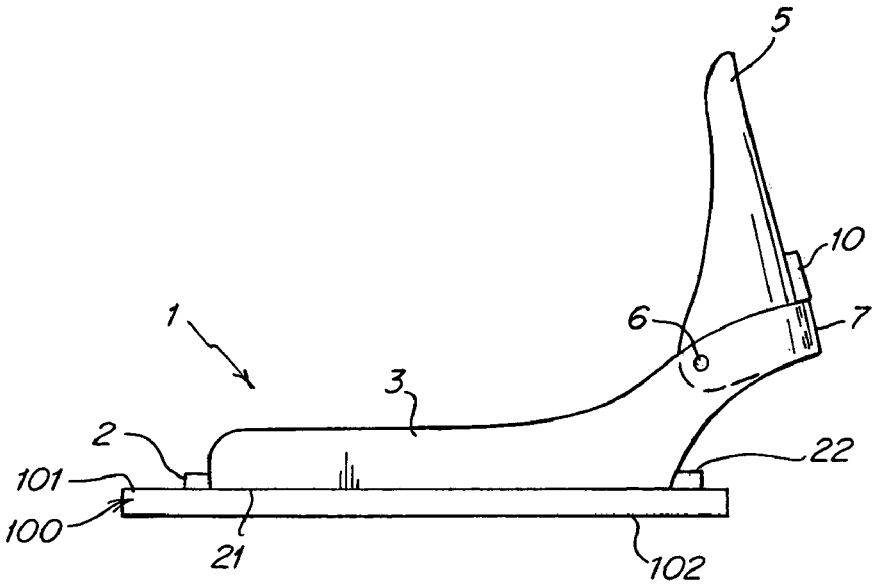
Fig. 16 PRIOR ART
FIG. 16 shows a second embodiment of a prior art strap binding.
Figure 17:
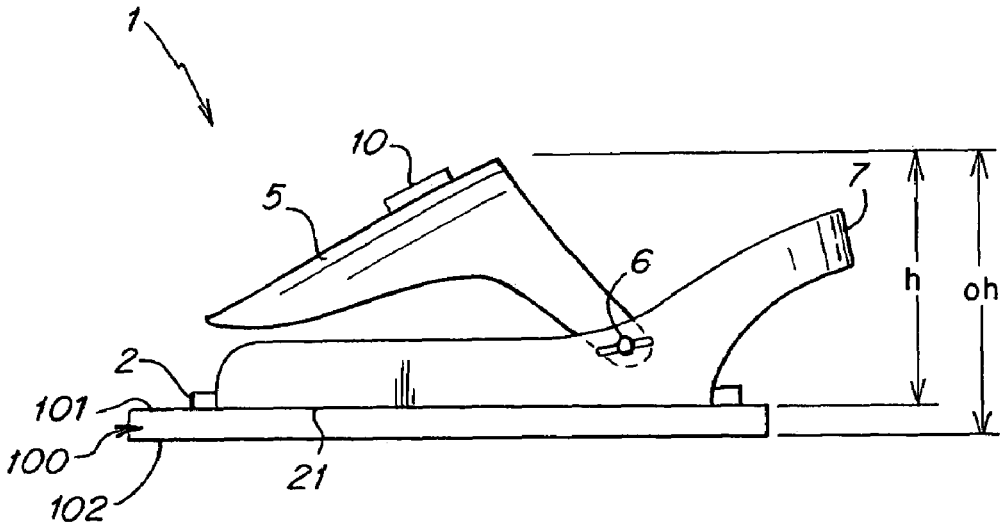
Fig. 17 PRIOR ART
FIG. 17 shows the FIG. 15 binding with the highback in a folded position.
Figure 18:
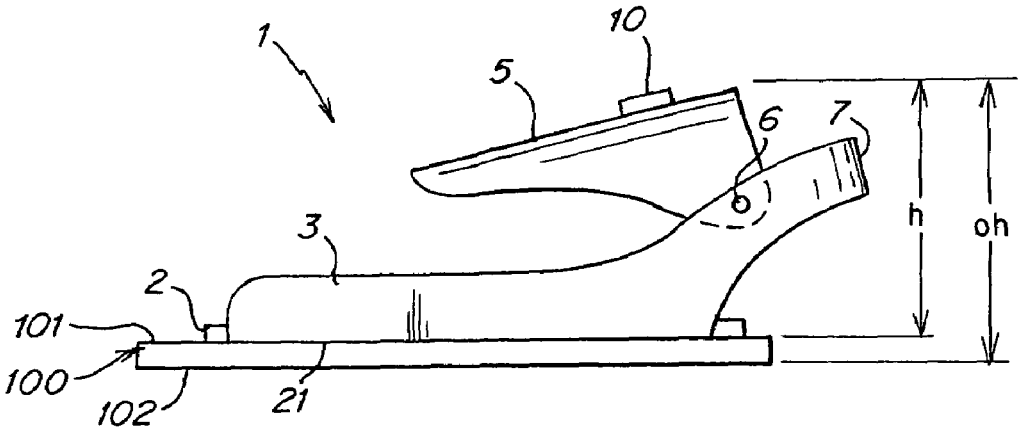
Fig. 18 PRIOR ART
FIG. 18 shows the FIG. 16 binding with the highback in a folded position.

One aspect of the invention illustrated in the snowboard binding 1 of FIGS. 1–3 is a highback constructed and arranged to be movable between a riding position (FIG. 1) in which the highback is arranged to support the rear portion of a rider's leg, and a folded position (FIGS. 2 and 3) in which the highback 5 is adjacent the floor 22 of the base 2 and all portions of the highback are positioned at a height less than a a height of an uppermost portion of a heel hoop 7 above the bottom surface 21 of the base 2. Although the highback 5 and other portions of the binding 1 may be constructed and arranged in different ways to provide this aspect of the invention (as discussed in connection with other illustrative embodiments below), in this illustrative embodiment the highback is pivotally coupled to the base 2 at a point near the bottom 21 of the binding 1 and relatively near the rearmost portion of the heel hoop 7. This coupling along with the geometry of the highback 5 is in contrast to many conventional highbacks like that shown in FIG. 16, which are pivotally mounted relatively high on the heel hoop. The high pivot point on these highbacks prevents the highbacks from lying below the heel hoop when folded down. Other conventional highbacks like that shown in FIG. 15 are pivotally mounted relatively low on the sidewalls near the mid-point of the binding, but these highbacks have relatively long arms, or portions that extend on lateral sides from the rear of the highback near the heel hoop to the pivot point. These long arms extend the height of the highback when folded such that portions of the highback extend above the uppermost portion of the heel hoop.

In another aspect of the invention illustrated in FIG. 3, the pivot point 6 for the highback 5 is located at a point that is at a distance d above the bottom surface 21 of the base 2 that contacts the top surface 101 of the snowboard 100 and a length l forward of the rearwardmost portion of the heel hoop 7. In this illustrative embodiment, the distance d is about 0.75 inches or less, and the length l is about 2.25 inches or less. This arrangement may allow the highback 5 to lie under the uppermost portion of the heel hoop 7 in the folded position, e.g., when the uppermost portion of the heel hoop 7 has a height h of about 3 inches or less from the bottom surface 21 of the base 2 and the floor of the base 2 has a thickness of about 0.5 inches or less. This pivot point placement has not been used in conventional strap bindings. That is, in conventional strap bindings, the heel hoop typically slopes upwardly away from the base at a rear end of the sidewalls and the uppermost portion of the heel hoop has been positioned at a height of about 3.25 inches or more to avoid potential problems with heel drag (i.e., contact of the rider's boot or portions of the binding with the snow or other gliding surface during a heel-side turn). Lowering the heel hoop in the prior art bindings would therefore not generally have been done because of the potential for creating heel drag problems. Because of the upward sloping and high position of the heel hoop, there typically is nothing in a conventional strap binding to connect a highback to at a point 0.75 inches or less from the bottom of the binding and 2.25 inches or less from the rearwardmost portion of the heel hoop. In the illustrative embodiment shown in FIG. 3, the heel hoop 7 is lowered in a portion near the pivot point and is arranged at a portion 74 so that it is raised above the bottom surface 21 for a distance, and then slopes upwardly rearward of the pivot point 6. Although this arrangement is not necessary in all aspects of the invention, it may provide the desired pivot point location while aiding in avoiding heel drag problems.

Figure 4:
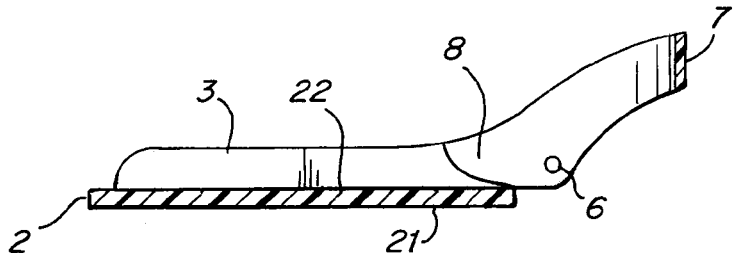
FIG. 4 shows a cross-sectional view along the line 4—4 in FIG. 2.
Figure 5:
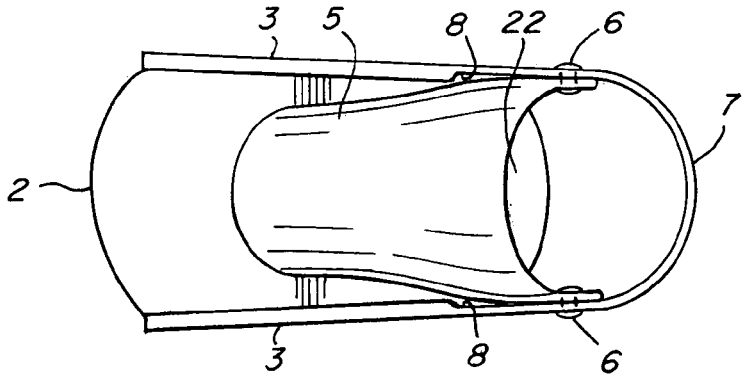
FIG. 5 shows a top view of the FIG. 1 embodiment.

In another aspect of the invention, the highback may be mounted relative to the base at a position no more than 0.75 inches from the bottom surface of the base and rearward of a rearwardmost portion of a floor of the base. As can be seen in FIGS. 3–5, the pivot point 6 in the illustrated embodiment is located at a position rearward of the rearwardmost portion of the floor 22 of the base 2. This location for the pivot point 6 can help avoid contact of the highback 5 with the rider's boot at or near the pivot point 6 while providing a suitably low pivot so the highback can lie relatively low in the folded position.

In another aspect of the invention, all portions of the binding 1 lie below a height h of approximately 3 inches, preferably below 2.75 inches, and more preferably below 2.5 inches when the highback is in the folded position. That is, in this aspect of the invention, the uppermost portion of the heel hoop 7 (if present) and the uppermost portion of the highback 5 when in the folded position have a height h of 3 inches or less from the bottom surface 21 of the base 2. In this aspect of the invention, the uppermost portion of the highback 5 may be positioned above the uppermost portion of the heel hoop 7, yet still remain at or below the 3 inch or less maximum height. Thus, in this aspect of the invention, the highback 5 need not necessarily lie below the heel hoop 7. In an embodiment in which the maximum height h of the binding 1 is 2.5 inches or less, boards having such bindings mounted on them may be stored in a same type of rack previously used only for storing step-in bindings with no highback. This can be advantageous for snowboard rental shops which may use the same racks to store boards with step-in or strap bindings.

In another aspect of the invention, a portion 52 of the highback 5 where the highback 5 contacts a rider's boot is provided relatively high on the highback 5 as compared to prior highbacks. That is, in prior highbacks, the portion of the highback that contacts a rider's boot is typically positioned near the uppermost portion of the heel hoop, i.e., near the point where the highback contacts the heel hoop. Since this portion of the highback receives a great amount of stress during riding, the portion is typically made thicker and/or contoured to increase the strength of the highback, especially in the case of all-plastic highbacks. However, when such highbacks are folded down, the thicker portion of the highback typically is positioned at an uppermost portion of the highback and therefore increases the height of the folded highback. In one aspect of the invention, a portion 52 of the highback that contacts a rider's boot is positioned relatively high above the uppermost portion of the heel hoop. As can be seen in FIG. 3, the uppermost portion of the highback 5 when folded typically is that portion 53 of the highback 5 that is positioned near the heel hoop when in the riding position. However, the highback 5 slopes downwardly from the uppermost portion toward the toe end of the binding when in the folded position. Therefore, although the portion 52 may be made thicker or otherwise shaped or configured to increase the strength at the portion 52, the portion 52 is located on a downward sloping section forward of an uppermost portion of the highback when in the folded position (seen best in FIG. 3) and has no or a minimal impact on the overall height of the highback.

In another aspect of the invention, portions of the sidewall of a binding may include a recess to receive at least a portion of the highback when the highback is in a folded position. As can be seen in FIGS. 4 and 5, in one illustrative embodiment, recesses 8 in the sidewalls 3 may be formed to receive at least a portion of the highback 5 when it is folded down. In this illustrative embodiment, the recesses 8 are formed in both sidewalls 3 near the pivot point 6, but a recess 8 may be formed in any suitable location and/or only in one sidewall 3 rather than both sidewalls 3. Alternately, or in addition, portions of the floor of the base 2 may be recessed to receive a portion of the highback in the folded position to further reduce the height of the highback 5.

As was mentioned above, the highback may be coupled in any suitable way relative to the base to achieve various aspects of the invention. For example, moving the pivot point for the highback downward and rearward as in FIGS. 1–3 may increase the stress in the highback at and near the contact area between the highback and the heel hoop and at the pivot point 6 by shortening the horizontal distance and lengthening the vertical distance between the pivot point 6 and the area of contact between the highback and heel hoop. In prior bindings in which the highback has relatively long arms that are pivotally connected to the sidewalls at a point near the middle of the binding (e.g., in FIG. 15), the long horizontal arms reduce the stress at the pivot point connection when a rider applies a moment to the highback during a heel-side turn. Thus, the arms on the highback extending to the pivot point may be made relatively thin and not interfere with the rider's foot in the binding. Other bindings that had a shorter horizontal distance between the pivot point and the contact area between the highback and the heel hoop typically had the highback mounted relatively high on the heel hoop (e.g., in FIG. 16). This arrangement potentially provided two advantages. First, since the pivot point was nearer the rider's ankle, the highback tended to rotate about a more natural pivot point (the rider's ankle) than other arrangements. Second, the high pivot placement allowed the highback to be made thicker and more robust at the pivot point since the rider's foot and boot are typically more narrow at the rider's ankle than at the sole.

Figure 6:
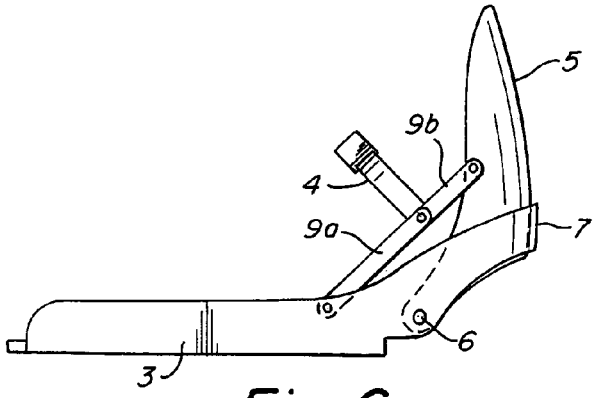
FIG. 6 shows a side view of another illustrative embodiment having a link interconnected between the base and a highback.
Figure 7:
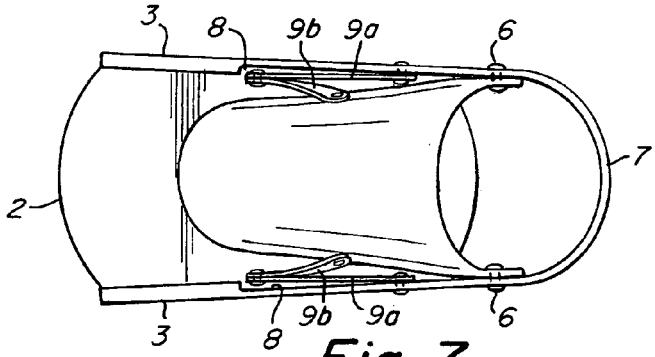
FIG. 7 shows a top view of the FIG. 6 embodiment with the highback in a folded position.

In contrast, bindings in accordance with aspects of the invention have the pivot point for the highback mounted to the heel hoop relatively low and positioned to the rear. In some embodiments, additional structure may help support the highback during riding. For example, FIG. 6 shows one illustrative embodiment in which the highback 5 is mounted at a pivot point 6 similar to that in FIG. 1, but a link 9 is added to help support the highback while allowing the highback 5 to be moved to the folded position. The link 9 includes two portions 9*a* and 9*b* that are respectively pivotally coupled at a base end to the base 2 or sidewall 3 and at a highback end to the highback 5. The two portions 9*a* and 9*b* are pivotally coupled to each other so that the portions 9*a* and 9*b* fold into a configuration like that shown in FIG. 7 when the highback 5 is in the folded position. Recesses 8 may be provided in the sidewalls 3 to receive the links 9 on either lateral side of the highback 5. In this embodiment, an ankle strap 4 is coupled to the link 9 (at the joint between the two portions 9*a* and 9*b*), but the ankle strap 4 may be coupled to the sidewalls 3 or in any other suitable way. Of course, it should be understood that the links 9 may be made in other ways, e.g., include a flexible webbing, cable or chain, include a stiff bar or strap that is removably coupled to the highback or base to allow folding of the highback, etc.

Figure 8:
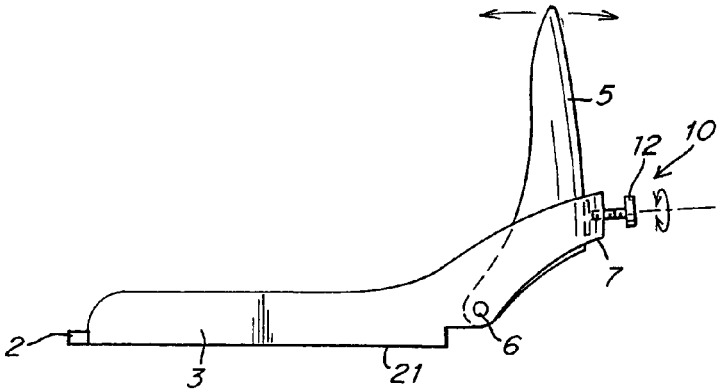
FIG. 8 shows a side view of an illustrative embodiment of a forward lean adjuster in accordance with the invention.
Figure 9:
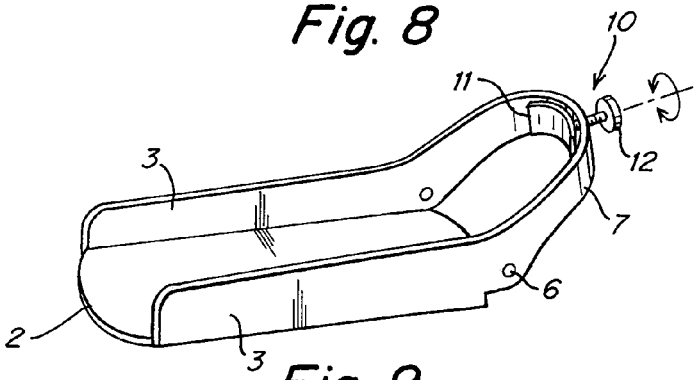
FIG. 9 shows a perspective view of the FIG. 8 embodiment.

In another aspect of the invention, a binding may have a lean adjuster that adjusts the angle of the highback relative to the base while not increasing the height of the highback in the folded position. Conventional lean adjusters are typically mounted to the rear of the highback and contact the heel hoop to adjust the angle of the highback. However, such lean adjusters usually are the highest portion of the highback when in the folded position because of their location on the rear of the highback. In one aspect of the invention, a lean adjuster may have a portion that moves in a direction parallel to the top surface of a snowboard to adjust the lean angle of the highback. For example, as shown in FIG. 8, a lean adjuster 10 may include a threaded portion and a knob that may threadedly engage with the heel hoop 7 and move horizontally to adjust the angle of the highback 5 about the pivot point 6. This arrangement may not increase the height of the binding 1 when the highback is in the folded position, while providing a suitably low profile to avoid contact with the riding surface during typical heel-side turns, e.g., prevent unwanted heel drag characteristics. As can be seen in FIG. 9, the lean adjuster may include a pusher element 11 that is positioned between an inner surface of the heel hoop 7 and the highback 5 that is moved by the threaded portion and knob 12.

Figure 10:
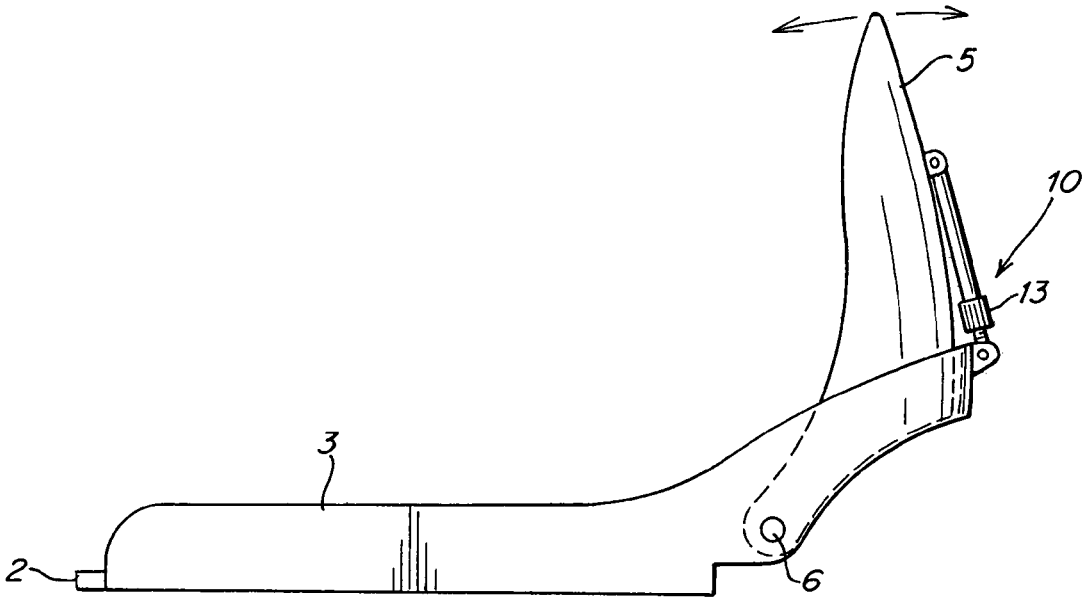
FIG. 10 shows a side view of another illustrative embodiment of a snowboard binding having a forward lean adjuster.
Figure 11:
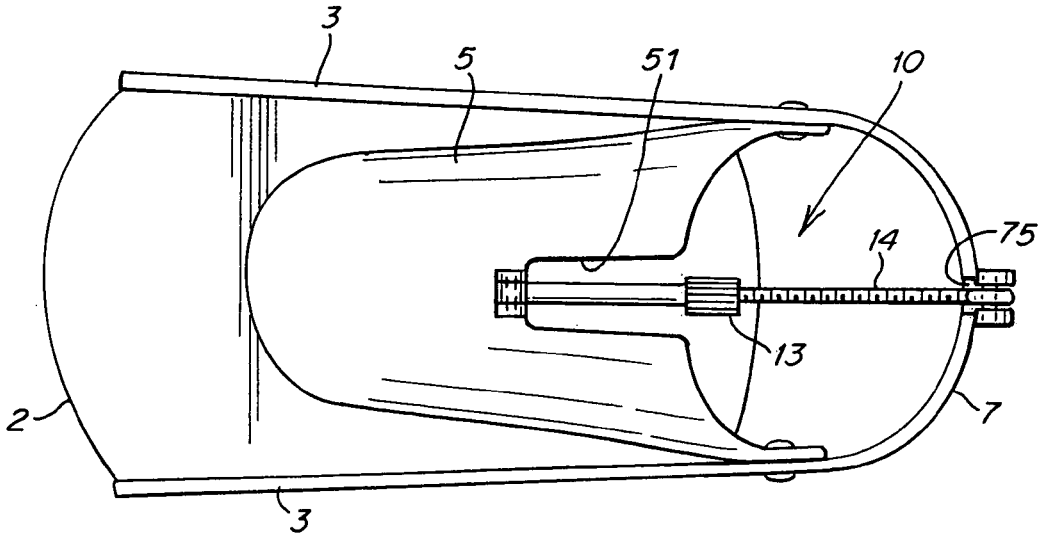
FIG. 11 shows a top view of the FIG. 10 embodiment.

It will be understood that the lean adjuster may be arranged in other ways. For example, FIG. 10 shows a lean adjuster 10 that includes a turnbuckle-type element to adjust the lean angle of the highback 5. As can be seen in FIG. 11, rotation of a barrel 13 threadedly engaged with a rod 14 may adjust the length of the lean adjuster 10. The lean adjuster 10 may be pivotally coupled at opposite ends to the heel hoop 7 and the highback 5 and include slidably engaged portions to allow the highback 5 to be moved to the folded position. The highback 5 may include an opening or recess 51 to receive at least a portion of the lean adjuster 10 in the folded position. Likewise, the heel hoop 7 may include a recess or groove 75 to receive at least a portion of the lean adjuster 10 when in the folded position so that the uppermost portion of the heel hoop 7 is positioned higher than any portion of the lean adjuster 10.

Figure 12:
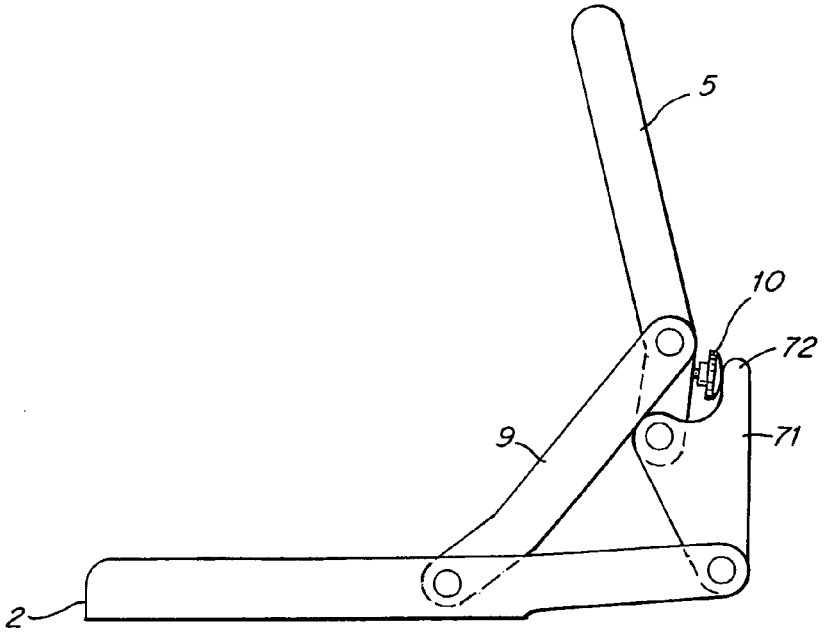
FIGS. 12–14 show side views of an illustrative embodiment having a highback coupled by front and back links to a base.
Figure 13:
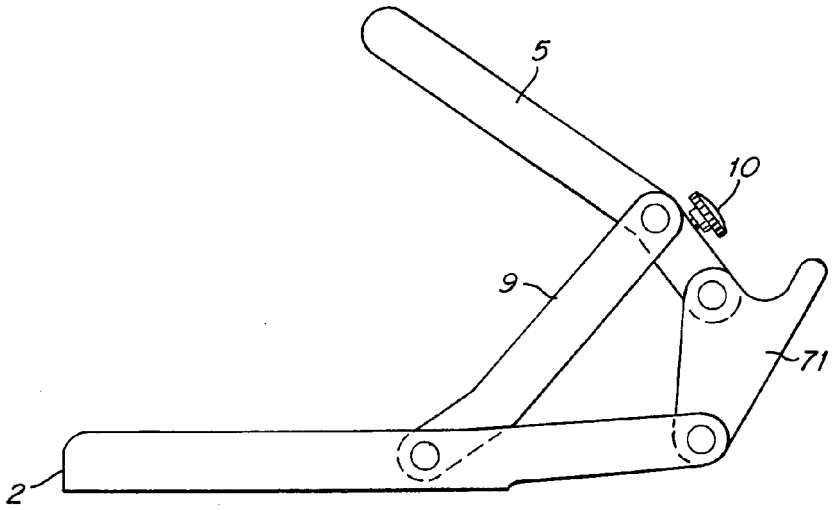

In another aspect of the invention, a highback may be coupled to a binding base by two links such that the highback may be moved between riding and folded positions. The two links may be positioned so as to form a four bar linkage that couples the highback and the base. For example, FIG. 12 shows a schematic representation of an illustrative embodiment in which a highback 5 is coupled to a base 2 by a first link 9 and a second link 71. FIG. 12 shows the highback 5 in the riding position. Lean adjustment of the highback 5 may be made by moving a lean adjuster 10 to change the distance between a tab 72 on the second link 71 and the highback 5. In this embodiment, the lean adjuster includes a threaded portion and knob that may move horizontally when rotated, but the lean adjuster 10 may be arranged in any suitable way. To move the highback 5 to a folded position, the second link 71 may be rotated clockwise while rotating the highback 5 counterclockwise, as shown in FIG. 13. Continued rotation of the second link and highback 5 results in the highback being positioned approximately parallel to the base 2 in the folded position. As will be appreciated by those of skill in the art, the links 9 and 71 and portions of the highback 5 and base 2 function as links in a four bar linkage.

Figure 14:
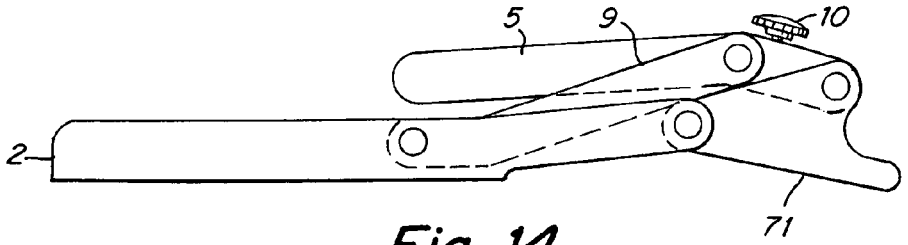

Although FIGS. 12–14 show a schematic side view of a binding, it should be understood that first and second links 9 and 71 may be provided on both lateral sides of the binding. Alternately, the second link 71 may be provided as a single piece that extends across the back of the binding 1 as a heel hoop.

While the invention has been described with reference to various illustrative embodiments, the invention is not limited to the embodiments described. It is evident that many alternatives, modifications and variations of the embodiments described will be apparent to those skilled in the art. For example, illustrative embodiments described above include a heel hoop. However, the binding need not include a heel hoop at all, e.g., the highback may be mounted to the sidewalls or rearward extensions of the sidewalls. In addition, the heel hoop may be slidably mounted to the base so that the binding size can be adjusted to accommodate larger or smaller boot sizes. A portion of the floor of the base may also extend or retract with the heel hoop when changing the binding size. In another embodiment, the heel hoop may be pivotally mounted to the base to allow the heel hoop to be rotated to a low height for storage or other purposes. Accordingly, embodiments of the invention as set forth herein are intended to be illustrative, not limiting. Various changes may be made without departing from the scope of the invention.

What is claimed is:

1. A snowboard binding comprising:

a base constructed and arranged to be mounted to a snowboard and to support at least a portion of a bottom of a rider's foot, the base having a bottom surface that is adjacent a snowboard top surface when the base is mounted to the snowboard;

at least one engagement member constructed and arranged to extend across the rider's foot and secure the rider's foot to the base;

a heel hoop extending from the base and constructed and arranged to extend around a rider's heel when the rider's foot is positioned in the binding, the heel hoop having an uppermost portion and a rearwardmost portion; and a rear support member, including a highback, constructed and arranged to support a rear portion of the rider's leg, the rear support member being movable between a riding position in which the rear support member is arranged to support the rear portion of the rider's leg and a folded position in which all portions of the rear support member are positioned at a height from the bottom surface of the base that is less than a height of an uppermost portion of the heel hoop from the bottom surface of the base.

2. The binding of claim 1, wherein all portions of the rear support member and the heel hoop are positioned within a height of at most 3 inches from the bottom surface of the base when the rear support member is in the folded position.

3. The binding of claim 1, wherein all portions of the rear support member and the heel hoop are positioned within a height of at most 2.5 inches from the bottom surface of the base when the rear support member is in the folded position.

4. The binding of claim 1, wherein the highback is pivotally mounted relative to the base at a position no more than 0.75 inches from the bottom surface of the base and no more than 2.25 inches from the rearwardmost portion of the heel hoop.

5. The binding of claim 1, further comprising a lean adjuster constructed and arranged to adjust a rotational position of the highback relative to the base.

6. The binding of claim 1, further comprising:

a lean adjustment device that adjusts a rotational position of the highback relative to the base, the lean adjustment device being mounted to the heel hoop and having a movable portion that moves in a direction parallel to the snowboard top surface to adjust the rotational position of the highback.

7. The binding of claim 1, further comprising:

a lean adjustment device that adjusts a rotational position of the highback relative to the base, a portion of the lean adjustment device being positioned between the highback and an interior surface of the heel hoop.

8. The binding of claim 1, wherein the base has a toe side opposite a heel side, and the highback is movable from the riding position in a direction toward the toe side of the base to the folded position.

9. The binding of claim 1, wherein the engagement member is a variable length strap.

10. The binding of claim 1, further comprising sidewalls on opposite sides of the base and extending in a heel-to-toe direction.

11. The binding of claim 1, further comprising sidewalls on opposite sides of the base and extending in a heel-to-toe direction, at least one of the sidewalls including a recess to receive at least a portion of the highback when in the folded position.

12. The binding of claim 1, further comprising:

a first link pivotally coupled at a base end to the base and pivotally coupled at a highback end to the highback, wherein the highback is rotatable relative to the first link.

13. The binding of claim 12, wherein the first link includes two pivotally connected portions, a first portion being pivotally coupled to the base and a second portion being pivotally coupled to the highback.

14. The binding of claim 12, wherein at least one engagement member is coupled at one end to the first link.

15. The binding of claim 1, further comprising:

a first link pivotally coupled at a base end to the base and pivotally coupled at a highback end to the highback; and a second link pivotally coupled at a base end to the base and pivotally coupled at a highback end to the highback.

16. The binding of claim 15, wherein the first and second links are positioned on a same lateral side of the base, and the first link is positioned nearer a toe side of the base than the second link.

17. The binding of claim 1, wherein the highback is mounted relative to the base at a position no more than 0.75 inches from the bottom surface of the base and rearward of a rearwardmost portion of a floor of the base.

18. The binding of claim 1, wherein the highback is pivotally mounted to the heel hoop at a pivot position that is located rearward of a rearwardmost portion of a floor of the base.

19. The binding of claim 1, wherein a top portion of the highback does not extend beyond a toe end of the base when the highback is in the folded position.

20. A snowboard binding comprising:

a base constructed and arranged to be mounted to a snowboard and to support at least a portion of a bottom of a rider's foot, the base having a bottom surface that is adjacent a snowboard top surface when the base is mounted to a snowboard;

at least one engagement member constructed and arranged to extend across a rider's foot and to secure the rider's foot to the base;

a heel hoop extending from the base and constructed and arranged to extend around a rider's boot heel when the boot is positioned in the binding, the heel hoop having a rearwardmost portion; and a highback constructed and arranged to support a rear portion of the rider's leg, the highback pivotally connected relative to the base at a pivot position that is located no more than about 2.25 inches forward of the rearwardmost portion of the heel hoop and rearward of a rearwardmost portion of a floor of the base.

21. The binding of claim 20, wherein the highback is movable between a riding position and a folded position, and all portions of the highback and heel hoop are positioned within a height of at most 3 inches from the bottom surface of the base when the highback is in the folded position.

22. The binding of claim 20, wherein the highback is movable between a riding position and a folded position, and all portions of the highback and heel hoop are positioned within a height of at most 2.5 inches from the bottom surface of the base when the highback is in the folded position.

23. The binding of claim 20, further comprising a lean adjuster constructed and arranged to adjust a rotational position of the highback relative to the base.

24. The binding of claim 20, further comprising:

a lean adjustment device that adjusts a rotational position of the highback relative to the base, the lean adjustment device being mounted to the heel hoop and having a movable portion that moves in a direction parallel to the snowboard top surface to adjust the rotational position of the highback.

25. The binding of claim 20, further comprising:

a lean adjustment device that adjusts a rotational position of the highback relative to the base, a portion of the lean adjustment device being positioned between the highback and an interior surface of the heel hoop.

26. The binding of claim 20, wherein the highback is movable between a riding position and a folded position, the binding further comprising:

a lean adjustment device that adjusts a rotational position of the highback relative to the base, a portion of the lean adjustment device being coupled to the heel hoop and a portion of the lean adjustment device being coupled to the highback, wherein the highback includes an opening in which a portion of the lean adjustment device is received when the highback is in the folded position.

27. The binding of claim 20, wherein the highback is movable between a riding position and a folded position, the base has a toe side opposite a heel side, and the highback is movable from the riding position in a direction toward the toe side of the base to the folded position.

28. The binding of claim 20, wherein the engagement member is a variable length strap constructed and arranged to engage with a rider's boot.

29. The binding of claim 20, further comprising sidewalls on opposite sides of the base and extending in a heel-to-toe direction, at least one of the sidewalls including a recess to receive at least a portion of the highback when in the folded position.

30. The binding of claim 20, further comprising:

a first link pivotally coupled at a base end to the base and pivotally coupled at a highback end to the highback, wherein the highback is rotatable relative to the first link.

31. The binding of claim 30, wherein the first link includes two pivotally connected portions, a first portion being pivotally coupled to the base and a second portion being pivotally coupled to the highback.

32. The binding of claim 31, wherein the engagement member is coupled at one end to the first link.

33. The binding of claim 20, wherein a top portion of the highback does not extend beyond a toe end of the base when the highback is in the folded position.

34. A snowboard binding comprising:

a base constructed and arranged to be mounted to a snowboard and to support at least a portion of a rider's foot, the base having a bottom surface that is adjacent a snowboard top surface when the base is mounted to a snowboard;

a pair of sidewalls extending in a heel-to-toe direction on opposite sides of the base;

at least one engagement member constructed and arranged to extend across a rider's foot and secure the rider's foot to the base;

a heel hoop extending from the base and constructed and arranged to extend around a rider's boot heel when the boot is positioned in the binding, the heel hoop having a rearwardmost portion; and a highback constructed and arranged to support a rear portion of the rider's leg, the highback pivotally connected relative to the binding, the highback being movable between a riding position in which the highback is arranged to support a rear portion of the rider's leg and a folded position in which the highback is folded toward a toe side of the base;

wherein all portions of the highback and heel hoop are positioned within a height of at most 3 inches from the bottom surface of the base when the highback is in the folded position.

35. The binding of claim 34, wherein all portions of the highback and the heel hoop are positioned within a height of at most 2.5 inches from the bottom surface of the base when the highback is in the folded position.

36. The binding of claim 34, wherein all portions of the highback and heel hoop are positioned within a height of at most 2.75 inches from the bottom surface of the base when the highback is in the folded position.

37. The binding of claim 34, wherein the highback is pivotally mounted to the heel hoop at a position no more than about 2.25 inches from the rearwardmost portion of the heel hoop.

38. The binding of claim 34, further comprising:

a lean adjuster constructed and arranged to adjust a rotational position of the highback relative to the base.

39. The binding of claim 34, further comprising:

a lean adjustment device that adjusts a rotational position of the highback relative to the base, the lean adjustment device being mounted to the heel hoop and having a movable portion that moves in a direction parallel to the snowboard top surface to adjust the rotational position of the highback.

40. The binding of claim 34, further comprising:

a lean adjustment device that adjusts a rotational position of the highback relative to the base, a portion of the lean adjustment device being positioned between the highback and an interior surface of the heel hoop.

41. The binding of claim 34, wherein at least one of the sidewalls includes a recess to receive at least a portion of the highback when in the folded position.

42. The binding of claim 34, further comprising:

a first link pivotally coupled at a base end to the base and pivotally coupled at a highback end to the highback, wherein the highback is rotatable relative to the first link.

43. The binding of claim 42, wherein the first link includes two pivotally connected portions, a first portion being pivotally coupled to the base and a second portion being pivotally coupled to the highback.

44. The binding of claim 43, wherein the engagement member is coupled at one end to the first link.

45. The binding of claim 34, wherein a top portion of the highback does not extend beyond a toe end of the base when the highback is in the folded position.

46. A snowboard binding comprising:

a base constructed and arranged to be mounted to a snowboard and to support at least a portion of a rider's foot, the base having a bottom surface that is adjacent a snowboard top surface when the base is mounted to a snowboard;

a pair of sidewalls extending in a heel-to-toe direction on opposite sides of the base;

at least one engagement member constructed and arranged to extend across a rider's foot and secure the rider's foot to the base;

a heel hoop extending from the base and constructed and arranged to extend around a rider's boot heel when the boot is positioned in the binding, the heel hoop having a rearwardmost portion; and a highback constructed and arranged to support a rear portion of the rider's leg, the highback pivotally connected relative to the binding, the highback being movable between a riding position in which the highback is arranged to support a rear portion of the rider's leg and a folded position in which the highback is folded toward a toe side of the base;

wherein all portions of the highback and heel hoop are positioned within a height of at most 3 inches from the bottom surface of the base when the highback is in the folded position, and wherein the highback is mounted relative to the base at a position rearward of a rearwardmost portion of a floor of the base.

* * * * *